United States Patent [19]

Geberth, Jr.

[11] Patent Number: 4,611,758

[45] **Date of Patent: * Sep. 16, 1986**

[54] REVERSIBLE SPRAY TIP

[76] Inventor: John D. Geberth, Jr., 10 Goose Cove La., Ramsey, N.J. 07446

[ * ] Notice: The portion of the term of this patent subsequent to Apr. 2, 2002 has been disclaimed.

[21] Appl. No.: 634,706

[22] Filed: Jul. 26, 1984

Related U.S. Application Data

[63] Continuation-in-part of Ser. No. 451,926, Dec. 21, 1982, Pat. No. 4,508,268.

[51] Int. Cl.[4] ..... B05B 15/02

[52] U.S. Cl. ..... 239/119; 239/600; 277/27; 277/110

[58] Field of Search ..... 239/119, 288, 288.3, 239/391, 600, DIG. 22; 277/27, 110, 111, 112; 285/110

[56] References Cited

U.S. PATENT DOCUMENTS

| | | | |
|---|---|---|---|
| 3,042,248 | 7/1962 | Krueger | 285/110 |
| 4,437,610 | 3/1984 | Huber et al. | 239/119 |
| 4,477,109 | 10/1984 | Kleuver | 285/110 |
| 4,483,481 | 11/1984 | Calder | 239/288.3 |
| 4,484,707 | 11/1984 | Calder | 239/288.3 |
| 4,508,268 | 4/1985 | Geberth, Jr. | 239/600 |

FOREIGN PATENT DOCUMENTS

| | | | |
|---|---|---|---|
| 511330 | 3/1955 | Canada | 285/110 |
| 1077012 | 3/1960 | Fed. Rep. of Germany | 285/110 |
| 860905 | 2/1961 | United Kingdom | 285/110 |

*Primary Examiner*—Joseph F. Peters, Jr.
*Assistant Examiner*—Michael J. Forman
*Attorney, Agent, or Firm*—Collard, Roe & Galgano

[57] ABSTRACT

There is provided a reversible spray tip of the type used with a spray device adapted for hydraulically atomizing and spraying liquids, the reversible spray tip includes a rotatable member mounted in the spray tip housing having a diametric bore therethrough terminating in a spray opening, the housing includes an axial bore communicating between the fluid passageway of the spray device and the diametric bore of the rotatable member, a sealing member is mounted in the axial bore of the housing and is provided with an axial fluid bore therethrough communicating between the fluid passageway of the spray device and the diametric bore of the rotatable member, the sealing member includes a resilient sealing washer disposed between the nozzle housing and the sealing face of the spray device. The sealing washer is undercut in the internal sidewall at the inlet end thereof so as to form an annular skirt abutting the sealing face of the spray device. This annular skirt is urged against the sealing face of the spray device by the high pressure fluid in the spray nozzle.

11 Claims, 7 Drawing Figures

FIG. 2
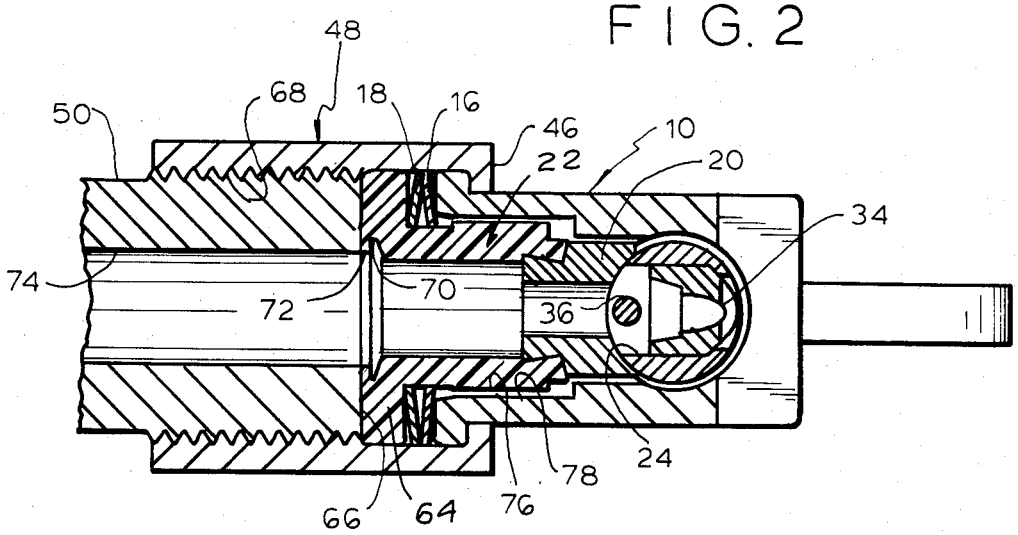
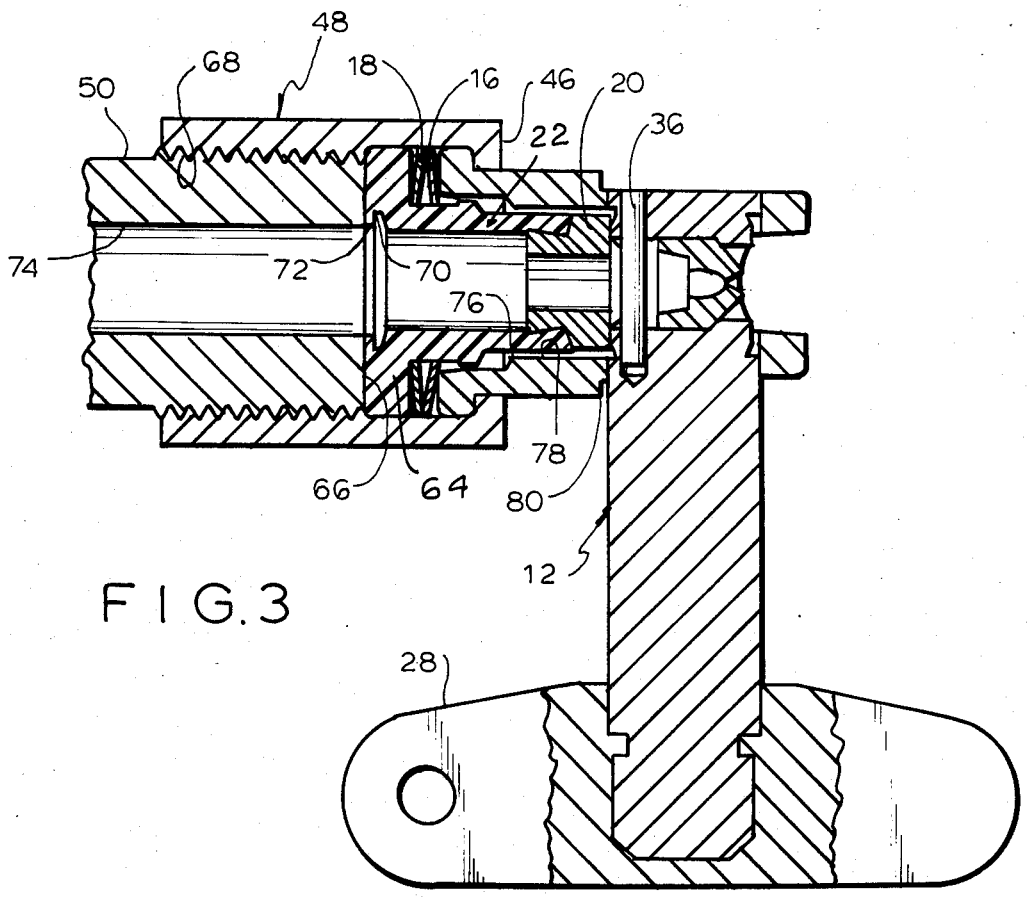
FIG. 3

FIG. 4
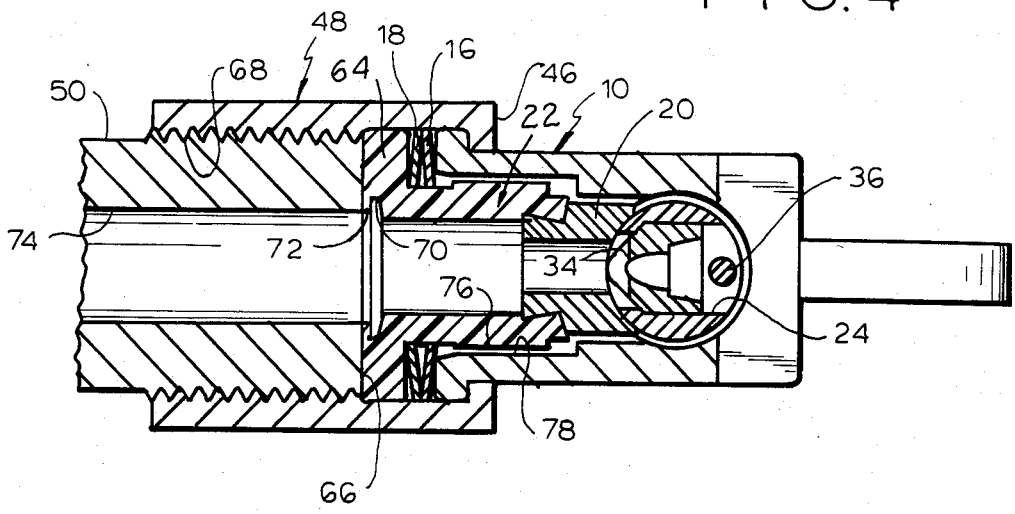
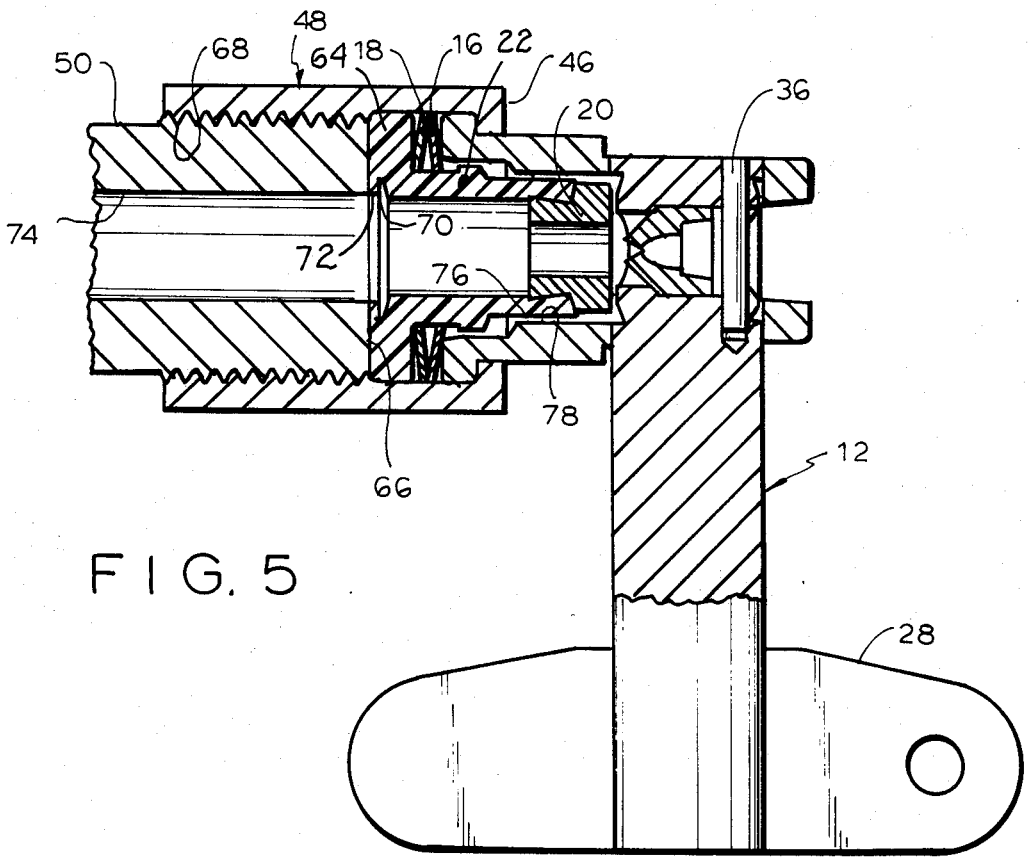
FIG. 5

REVERSIBLE SPRAY TIP

This application is a continuation-in-part of my earlier filed U.S. patent application Ser. No. 451,926, filed Dec. 21, 1982 now U.S. Pat. No. 4,508,268, issued Apr. 2, 1985.

The present invention relates generally to spray tips or nozzles for use with spray guns and like devices for hydraulically atomizing and spraying liquids such as paint. More particularly, the present invention relates to an improved reversible spray tip for the hydraulic atomization and spraying of liquids such as paint wherein the tip is reversible within a housing therefor so that obstructions which clog the nozzle may be easily removed by the reversed flow of the high pressure liquid therethrough.

In my earlier filed application entitled "REVERSIBLE SPRAY TIP", Ser. No. 451,926, filed Dec. 21, 1982, I describe a reversible spray tip for use in hydraulic atomization and spraying of paint which includes a cylindrically shaped rotatable member having a diametrically transverse fluid bore terminating in a spray opening housed transversely in a housing therefor. A resilient sealing member is provided in the housing which is in complementary abutting engagement with the cylindrical member encompassing a circumferential portion thereof which includes the spray opening. Alternatively a metallic tip or ceramic tip may be disposed between the resilient sealing member and the cylindrical member. The resilient sealing member includes a circumferentially expanded base portion in the form of a washer adjacent the forward end of the spray gun barrel which is pinioned between the housing for the reversible tip and the sealing face of the spray gun barrel. A spring washer is also disposed between the spray tip housing and the washer-like base of the sealing member in order to permit ready disengagement of the sealing member from the cylindrical member when the reversible spray tip is dismounted from the spray gun. A securing nut engages the spray tip housing and secures it against the washer-like base of the sealing member to the sealing face of the front end of the spray gun barrel.

However, it has been found in utilizing this reversible spray, tip, as well as other reversible spray tips wherein a rotatable cylindrical or spherical member is provided in a spray tip housing secured to the spray gun with a resilient sealing washer or member, as the tightening force provided by the securing nut is increased in order to effectuate the seal between the resilient sealing member and the sealing face of the spray gun barrel, the turning force required for the rotatable member is increased. Thus, it is possible to increase the securing force of the spray tip to the spray gun to such an extent that it may be impossible, or at least very difficult, to rotate the rotatable member of the reversible spray tip and thereby hamper its utility. On the other hand, if the securing force is insufficient, then leakage will occur at the interface between the resilient sealing member and the sealing face of the forward end of the spray gun barrel. There is, therefore, a fairly delicate balance which must be drawn between these two undesirable alternatives.

The primary object of the present invention is to provide a reversible spray tip for a spray gun or like device having a rotatable member therein, the rotation of which reverses the attitude of the spray opening with respect to the fluid flow, wherein the resilient sealing member is improved so that less securing force is required in securing the spray tip housing to the spray gun barrel thus permitting easier rotation of the rotatable member of the reversible spray tip.

The above object, as well as others which will hereinafter become apparent, is accomplished in accordance with the present invention by the provision in a reversible spray tip of the type having a rotatable member with a diametrically transverse fluid bore therein terminating in a spray opening, a housing for rotatably accepting said rotatable member transversely therein, a resilient sealing member disposed between said housing and the sealing face of the forward end of the barrel of a spray gun or like device and a securing nut securing the spray tip to the spray gun barrel, of an undercut in the sidewall of the internal bore of the disk-like washer portion of the resilient sealing member. The undercut should be of such an extent that it penetrates into the sealing member at least parallel to the sealing face of the front end of the barrel of the spray gun and should also form an internal annular skirt portion in the disk-like portion of the sealing member abutting the sealing face of the spray gun which in its relaxed state is beveled outwardly from the washer. As the securing nut tightens the spray tip against the front or sealing face of the spray gun, the outwardly beveled annular skirt of the washer portion of the resilient sealing member is flattened against the sealing face of the spray gun, thus enhancing the seal thereat. In addition, when the high pressure fluid to be sprayed enters into the reversible spray tip from the fluid bore of the gun barrel and contacts the internal sidewall of the resilient sealing member, it also enters the undercut therein and exerts pressure against the internal skirt defined by the undercut thereby urging or biasing the skirt against the sealing face of the spray gun barrel and further enhancing the fluid seal between the sealing member and the sealing face of the spray gun barrel.

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views:

FIG. 2 is a horizontal cross-sectional view of the assembled reversible spray tip of FIG. 1;

FIG. 3 is a vertical cross-sectional view of the assembled reversible spray tip of FIG. 1;

FIG. 4 is a cross-sectional view of the assembled reversible spray tip similar to FIG. 2 shown in the reversed position;

FIG. 5 is a cross-sectional view similar to FIG. 3 of the assembled reversible spray tip shown in the reversed position;

Figures 1, 6, 7:
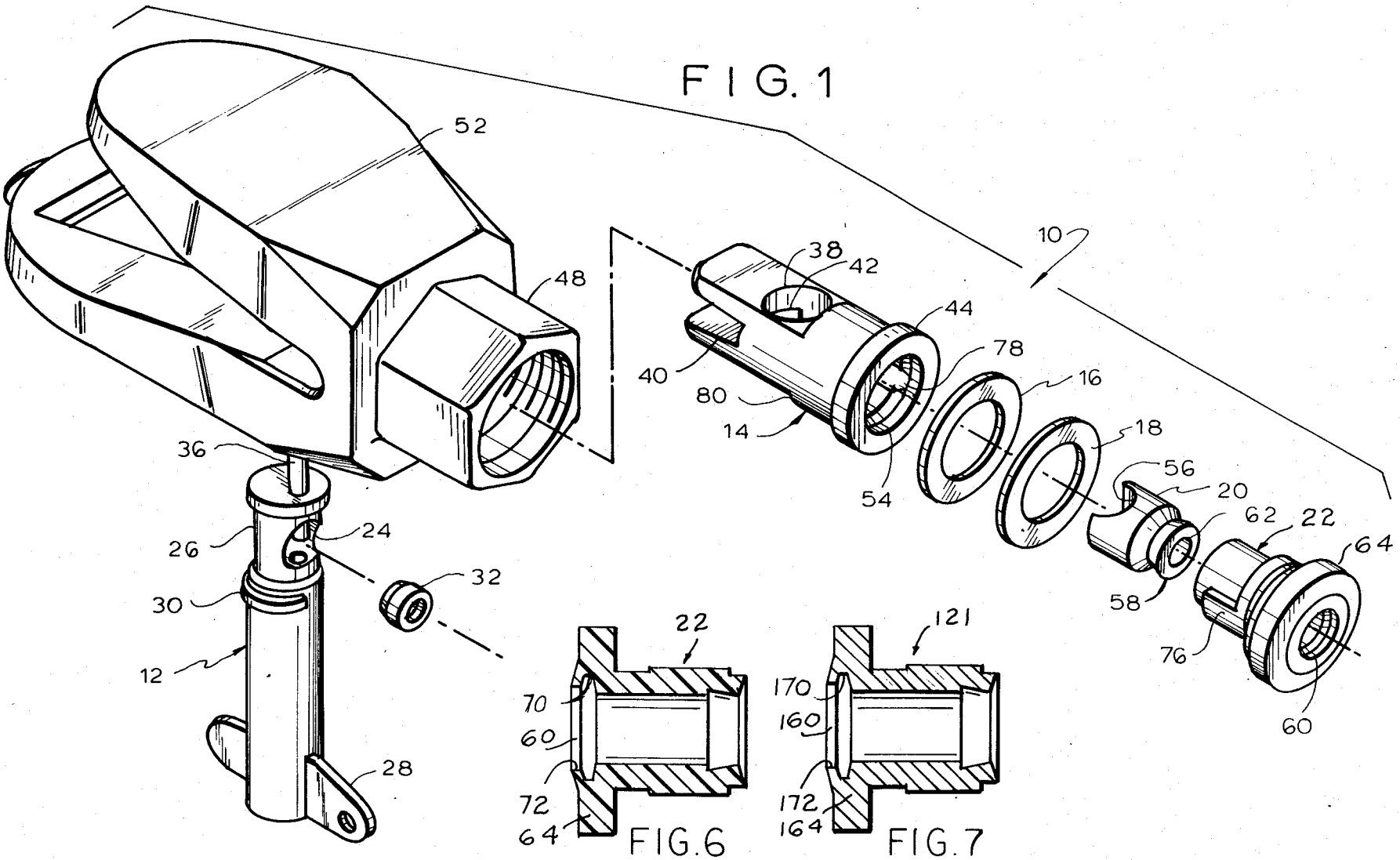
FIG. 1 is an exploded perspective view of a reversible spray tip embodying the present invention shown together with a safety guard.
FIG. 6 is a cross-sectional view of the sealing member utilized in the reversible spray tip according to the present invention.
FIG. 7 is a cross-sectional view of another embodiment of the sealing member utilized in the reversible spray tip according to the present invention.

Referring now to the drawings, there is shown in FIG. 1 a reversible spray tip, generally designated 10, which is essentially the same as that disclosed in my above referenced co-pending U.S. application, Ser. No. 451,926, entitled "REVERSIBLE SPRAY TIP". Reversible spray tip 10 basically includes a cylindrically shaped member, designated 12, a housing therefor, designated 14, a pair of spring washers, designated 16 and 18, a metallic sealing member, designated 20, and a resilient sealing member, designated 22. Cylindrically shaped member 12 is provided with a diametric transverse bore, designated 24, a circumferential undercut portion encompassing bore 24, designated 26, a key handle, designated 28, and a positioning tab, designated 30, extending partially about the circumference of cylindrical member 12.

Diametric bore 24 has press fitted therein a spray designated 34, at one end of bore 24. A deflector pin, designated 36, is press fitted into cylindrical member 12 to be positioned transversely of bore 24 at the end thereof opposite spray opening 34. Preferably, tip insert 32 is formed of a very hard material, such as tungsten carbide, so that premature wear of spray opening 34 does not occur.

Spray tip housing 14 is provided with a cylindrically shaped transverse bore, designated 38, for accepting for rotational movement therein cylindrical member 12. The forward end of housing 14 has a slot, designated 40, formed therein which intersects transverse bore 38 forming a forward aperture, designated 42, in bore 38. Aperture 42 in bore 38 is formed to coincide with diametric bore 24 of cylindrical member 12. A flange, designated 44, is provided at the other or inlet end of housing 14 for engagement by a complementary inwardly directed flange, designated 46, of a securing nut 48 for attaching the spray tip to a barrel, designated 50, of a non-illustrated spray gun. As clearly seen in FIG. 1, securing nut 48 may have attached thereto a safety guard, designated 52, which extends forwardly from the spray tip for the purpose of preventing accidental injection of the high pressure fluid into an operator or an on-looker.

An axial bore, designated 54, is provided in housing 14 and is adapted to accept therein metallic sealing member 20. Axial bore 54 extends to and intersects transverse bore 38 in housing 14. Sealing member 20 is provided at its end facing cylindrical member 12 with a concave surface, designated 56, which mates with the cylindrical surface of cylindrical member 12 at undercut portion 26 thereof. The other or inlet end of metallic sealing member 20 is adapted to engage with resilient sealing member 22. This may be accomplished by an interference fit of a necked down portion 58 of member 20 into the axial bore, designated 60, of resilient sealing member 22 thereby forming a unitary sealing member. It may also be accomplished by molding resilient sealing member 22 onto the necked down portion 58 of sealing member 20. In this case it is possible to dove-tail necked down portion 58 into axial bore 60 of resilient sealing member 22, as clearly seen in FIGS. 2 to 5. An axial bore, designated 62, is provided in metallic sealing member 20 for communication between bore 60 of resilient sealing member 22 and bore 24 of cylindrical member 12. At the spray gun or inlet side of resilient sealing member 22, there is provided a disk-like flange or washer, designated 64, which establishes a seal between reversible spray tip 10 and the front or sealing face 66 of spray gun barrel 50. Resilient sealing member 22 is preferably formed of a solvent resistant plastic material such as Delrin (a trademark of E.I. Du Pont).

As clearly seen in FIGS. 2 to 5, spring washers 16 and 18 are disposed between flange 44 of housing 14 and washer 64 of resilient sealing member 22 and when spray tip 10 is mounted to spray gun barrel 50, the flange 46 of securing nut 48 grips flange 44 of housing 14 and urges the same against the tension of spring washers 16 and 18 as securing nut 48 is tightened on thread 68 of spray gun barrel 50. The force exerted by flange 44 on spring washers 16 and 18 is transmitted therethrough to washer 64 which is urged against sealing face 66 of spray gun barrel 50. As indicated above, the seal between washer 64 and sealing face 66 of spray gun barrel 50 is increased as securing nut 48 is further tightened on spray gun barrel 50. However, in endeavoring to increase the seal by tightening securing nut 48, it is also possible to create excessive force between surface 56 of sealing member 20 and the undercut portion 26 of cylindrical member 12 such that the rotation of cylindrical member 12 in housing 14 is thereby hindered or prevented. Hence, it has been found that the provision of an undercut, designated 70 and clearly seen in FIG. 6, in the inner sidewall of bore 60 of resilient sealing member 22 near the inlet thereof and the formation of annular skirt 72 thereby which is outwardly beveled with respect to the sealing face of washer 64 will permit a reduction in the securing force necessary to be exerted by securing nut 48 in urging spray tip 10 into sealing contact with spray gun barrel 50. In the example shown in the drawings, undercut 70 is substantially V-shaped, however, other shapes which result in the formation of an annular skirt such as skirt 72 will also accomplish the desired result. Annular skirt 72 abuts sealing face 66 of spray gun barrel 50, as clearly seen in FIGS. 2 to 5, and its outward bevel is flattened thereagainst as securing nut 48 is tightened on thread 68 of spray gun barrel 50. Because of the resiliency of annular skirt 72, this flattening thereof has the effect of enhancing the seal between washer 64 and sealing face 66 of spray gun barrel 50.

In operation, when the high pressure fluid to be sprayed by spray tip 10 fills bore 74 of the spray gun and bores 60, 62 and 24 of the spray tip to thereby exit at spray opening 34, the fluid pressure is exerted on undercut 70 of flange 64 and against annular skirt 72 which is then urged against sealing face 66 of spray gun barrel 50. This action of annular skirt 72 against sealing face 66 further enhances the seal between washer 64 of resilient sealing member 22 and sealing face 66 of spray gun barrel 50. Also, since bore 54 of housing 14 and the outside wall of sealing member 22 are closely dimensioned, the outward pressure of the fluid in bore 60 of sealing member 22 cannot expand sealing member 22 radially outward.

Since bore 54 of housing 14 and sealing members 20 and 22 are circular or cylindrical in shape, locating keys, designated 76, are provided on the exterior surface of sealing member 22 for engagement with keyways 78 provided in bore 54 of housing 14. In this manner, with metallic sealing member 20 being fixedly engaged with resilient sealing member 22, when keys 76 of sealing member 22 are aligned with keyways 78 of housing 14 and the unitary sealing member is inserted into bore 54 of housing 14, the concave face 56 of sealing member 20 is in a correct attitude with respect to cylindrical member 12.

Positioning tab 30 of cylindrical member 12 is adapted to engage with a rotational stop, designated 80, on housing 14 adjacent transverse bore 38 such that cylindrical member 12 may be rotated between two positions 180° apart. Thus, cylindrical member 12 may be positioned as shown in FIGS. 2 and 3 with spray opening 34 facing forward for spraying or it may be rotated 180° so that spray opening 34 is reversed as shown in FIGS. 4 and 5.

It has also been found that with the provision of an undercut as above described in the sealing member, resulting in an outwardly beveled annular skirt adjacent the sealing face of a spray gun barrel, it is possible to construct the sealing member entirely of metal. Thus, as clearly seen in FIG. 7, a metal sealing member 121 is shown which is equivalent to sealing member 22 of FIGS. 1 to 6. Outwardly beveled annular skirt 172 formed by undercut 170 in bore 160 of washer portion 164 functions in the manner of a beveled spring washer when the spray tip is secured to a spray gun. Metal sealing member 121 may be formed by die-casting.

While only a single embodiment of the present invention has been shown and described, it will be obvious that many changes and modifications may be made thereunto without departing from the spirit and scope of the invention.

What is claimed is:

1. A spray nozzle for use with a spray device adapted for hydraulically atomizing and spraying liquids, the spray device having a fluid passageway communicating with conduit means connected to a source of liquid under pressure and a sealing face abutting said spray nozzle, said spray nozzle including:

a. a housing having a first axial bore communicating with the fluid passageway of said spray device and a second cylindrically shaped transverse bore intersecting said first axial bore;

b. a cylindrical member mounted for rotational movement in said cylindrically shaped transverse bore of said housing, said cylindrical member having a diametric bore therethrough communicating with said first axial bore of said housing and terminating in a spray opening;

c. a first sealing member in said first axial bore of said housing having an axial fluid bore therethrough communicating between the fluid passageway of said spray device and the diametric bore in said cylindrical member, the outlet end of said sealing member having a shape complementary to said cylindrical member and being in sealing engagement therewith;

d. a second sealing member including a resilient sealing washer disposed between said housing and the sealing face of said spray device;

e. means engaging said first sealing member with said cylindrical member to prevent transverse movement of said cylindrical member in said housing which includes an annular undercut provided in said cylindrical member which mates with the complementarily shaped outlet end of said first sealing member thereby preventing transverse movement of said cylindrical member;

f. means for securing said nozzle to said spray device and effecting sealing therebetween;

g. means for rotating said cylindrical member; and h. an undercut in the internal sidewall of said resilient sealing washer forming an annular skirt therein abutting the sealing face of said spray device.

2. The reversible spray nozzle as defined in claim 1, wherein said annular skirt of said resilient sealing washer abutting the sealing face of said spray device is outwardly beveled in the relaxed state.

3. The reversible spray nozzle as defined in claim 1, wherein said undercut in the internal sidewall of said resilient sealing washer is substantially V-shaped.

4. The reversible spray nozzle as defined in claim 1, wherein said second sealing member including said sealing washer thereof is formed of metal.

5. The reversible spray nozzle as defined in claim 1, wherein said second sealing member is constrained in said axial bore of said housing by said bore to prevent radial expansion thereof under the pressure of said liquid.

6. The reversible spray nozzle as defined in claim 1, which further includes stop means to permit 180° rotational movement of said cylindrical member so that the spray opening in the diametric bore thereof may be presented forwardly or rotated to a reversed position by the rotation of said cylindrical member.

7. The reversible spray nozzle as defined in claim 1, wherein said resilient sealing washer is formed of a resilient solvent resistant plastic material.

8. The reversible spray nozzle as defined in claim 1, wherein said first sealing member is formed of a hard material.

9. The reversible spray nozzle as defined in claim 8, wherein the hard material of said first sealing member is metal.

10. The reversible spray nozzle as defined in claim 8, wherein the hard material of said first sealing member is ceramic material.

11. The reversible spray nozzle as defined in claim 1, which further includes means biasing said cylindrical member from said first sealing member to disengage the means engaging said first sealing member with said cylindrical member to thereby permit transverse movement of said cylindrical member and removal thereof from the transverse bore of said housing, said biasing means being overcome by said securing means when said nozzle is secured to said spray device and sealing therebetween effected.

* * * * *